US006284330B1

(12) United States Patent
Hermanson

(10) Patent No.: US 6,284,330 B1
(45) Date of Patent: Sep. 4, 2001

(54) EXPANDABLE THREE-DIMENSIONAL DISPLAY DEVICE

(75) Inventor: Terry Hermanson, New York, NY (US)

(73) Assignee: Mr. Christmas, Inc., New York, NY (US)

( * ) Notice: Subject to any disclaimer, the term of this patent is extended or adjusted under 35 U.S.C. 154(b) by 0 days.

(21) Appl. No.: 09/550,901

(22) Filed: Apr. 17, 2000

Related U.S. Application Data

(63) Continuation-in-part of application No. 09/507,352, filed on Feb. 18, 2000.

(51) Int. Cl.[7] ..... A47G 33/04

(52) U.S. Cl. ..... 428/9; 428/12; 428/15; 428/99; 428/7; 40/530; 40/539; 40/540; 40/607; 446/487; 362/806

(58) Field of Search ..... 428/9, 12, 99, 428/15, 7; 40/530, 540, 607, 601, 539, 124.08; 446/487; 362/806, 808

(56) References Cited

U.S. PATENT DOCUMENTS 5,106,661 * 4/1992 Pitts, Sr. ..... 428/20
5,126,922 * 6/1992 Andrrasen ..... 362/32

* cited by examiner

*Primary Examiner*—Deborah Jones
*Assistant Examiner*—Abraham Bahta
(74) *Attorney, Agent, or Firm*—Fitzpatrick, Cella, Harper & Scinto

(57) ABSTRACT

An expandable three-dimensional display device is provided with a cover and a support post at least partially disposed within the cover. The display device includes a mechanism associated with the cover and support post that is operable alternately to expand the cover to an enlarged configuration about the post to provide a three-dimensional display and collapse the covers to a collapsed configuration. A light is mounted within the cover to illuminate it. Addition display structure is formed to be mounted on the upper end of the support post which projects through the cover and additionally to be secured to the cover in order to provide the assembled display with further texture and interest.

68 Claims, 6 Drawing Sheets

EXPANDABLE THREE-DIMENSIONAL DISPLAY DEVICE

CROSS REFERENCE

This application is a continuation-in-part of U.S. patent application Ser. No. 09/507,352, filed Feb. 18, 2000.

FIELD OF THE INVENTION

The present invention relates generally to a three-dimensional holiday display device. More specifically, the present invention relates to an expandable three-dimensional holiday display device that is easy to assemble and can also be illuminated.

In one example of the present invention, the expandable three-dimensional display device includes a support post with a movable extension mechanism having a sliding member and a plurality of extension members. The sliding member slidably moves along the support post such that the plurality of extension members can be extended generally radially away from the support post or retracted to collapse, and lie along and be generally parallel to the support post. A cover is supported by the extension members and is expanded and collapsed as the extension members extend and retract. This mechanism may be similar to a conventional umbrella.

The cover may be configured to represent an easily recognized holiday figure such as, for example, Santa Claus, the Easter Bunny or a snow man. Additionally, a light may be supported by the support post to illuminate the cover from within and render it visible after dark.

DESCRIPTION OF THE RELATED ART

Holiday display systems are often used to enhance the appearance of homes, offices and commercial establishments during holiday seasons. Such holiday displays are often illuminated to increase their visibility and attractiveness. Ideally, such illumination fixtures should be easily accessible to replace malfunctioning bulbs or to adjust the color and intensity of the illumination.

Two-dimensional display systems ordinarily are relatively lightweight and easy to assemble into a desired holiday scene. However, such two-dimensional displays do not meet the needs of certain applications. Three-dimensional display systems can appear realistic because they can be viewed from a wider field, and usually have the advantage of being inherently more sturdy. However, many such displays now known are relatively awkward to assemble and disassemble. Additionally, many conventional three-dimensional display systems are relatively heavy and are difficult to store due to their bulk.

Thus, a need exists for a three-dimensional holiday display that is relatively easy to assemble, light in weight yet sturdy, and which may be easily stored when not in use. Additionally, such a three-dimensional holiday display should also be attractively illuminated while allowing easy access to adjust or repair the device providing the illumination.

SUMMARY OF THE INVENTION

It is a first object of the present invention to provide a three-dimensional display device that is attractive and eye-catching when assembled.

It is another object of the present invention to provide a three-dimensional display device which may be easily assembled.

It is a further object of the invention to provide a three-dimensional display device which may be attractively illuminated, while providing easy access to adjust or repair the device providing the illumination.

It is yet another object of the present invention to provide a three-dimensional display device which may be easily and compactly stored when not in use.

It is a further object of the present invention to provide a three-dimensional display device that is relatively lightweight and sturdy.

In a first aspect of the present invention a three-dimensional display device is provided. The display device includes a flexible cover and a support post at least partially disposed within the cover. The display device also includes a cover operating mechanism associated with the cover and the support post that is alternately operable to expand the cover to an enlarged configuration to provide a three-dimensional display, and to collapse the cover about the support post.

A light fixture may be associated with the support post to illuminate the cover from within when the display device is in the expanded configuration.

In another aspect of the present invention the support post of the display device includes a mast that projects through the cover. An additional display structure is mounted on the mast above the cover to provide further interest and texture to the display when in its expanded configuration.

In another aspect the cover of the display device is provided with means at its lower margin for securing it to a base like the ground.

These and other aspects, objects, and features of the present invention will become apparent from the following description of the preferred embodiments of the present invention, read with reference to the accompanying drawings.

DETAILED DESCRIPTION OF THE PREFERRED EMBODIMENTS

Figure 1:
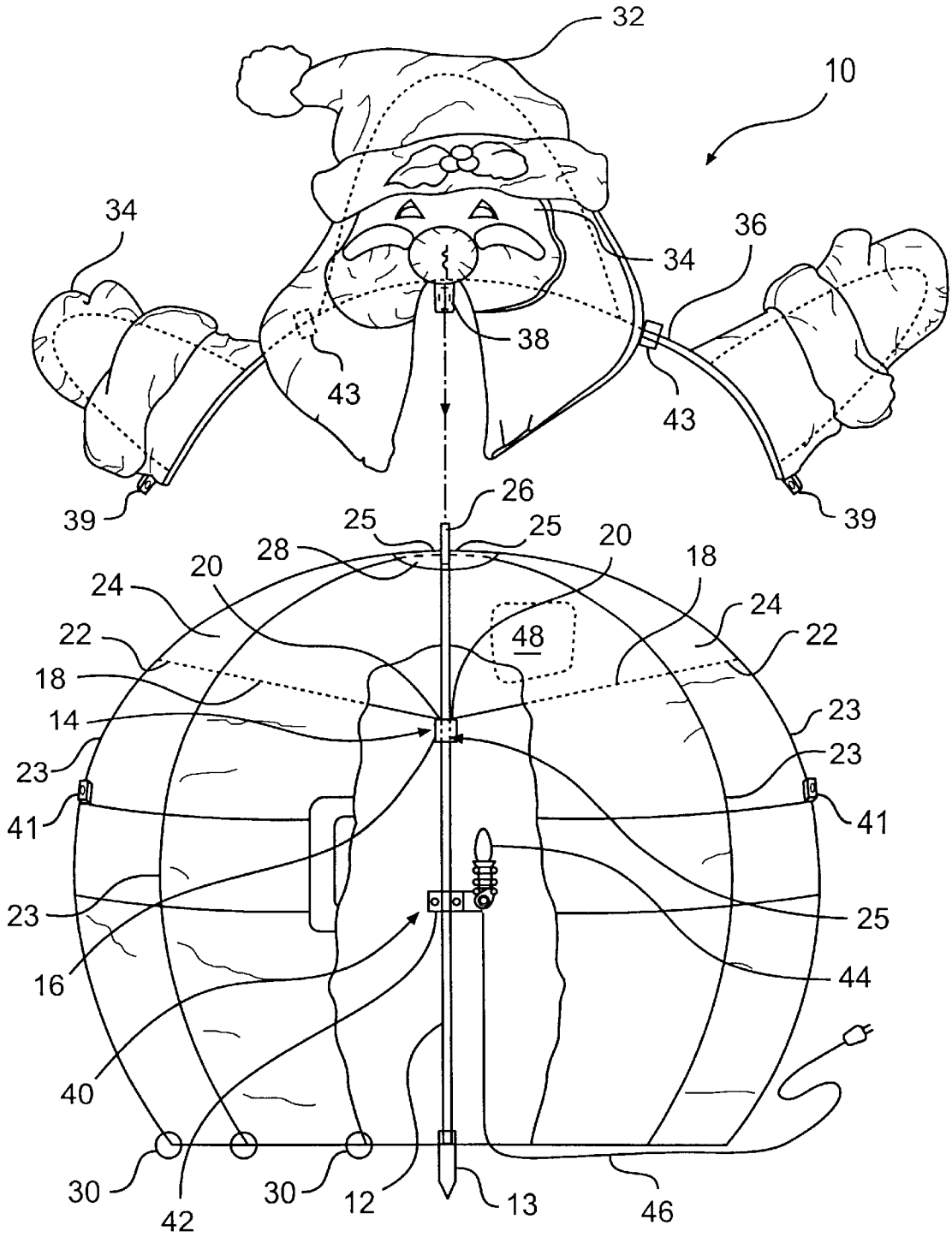
FIG. 1 is an elevational view of a preferred embodiment of a three-dimensional display device in an expanded position in accordance with the present invention.
Figure 2:
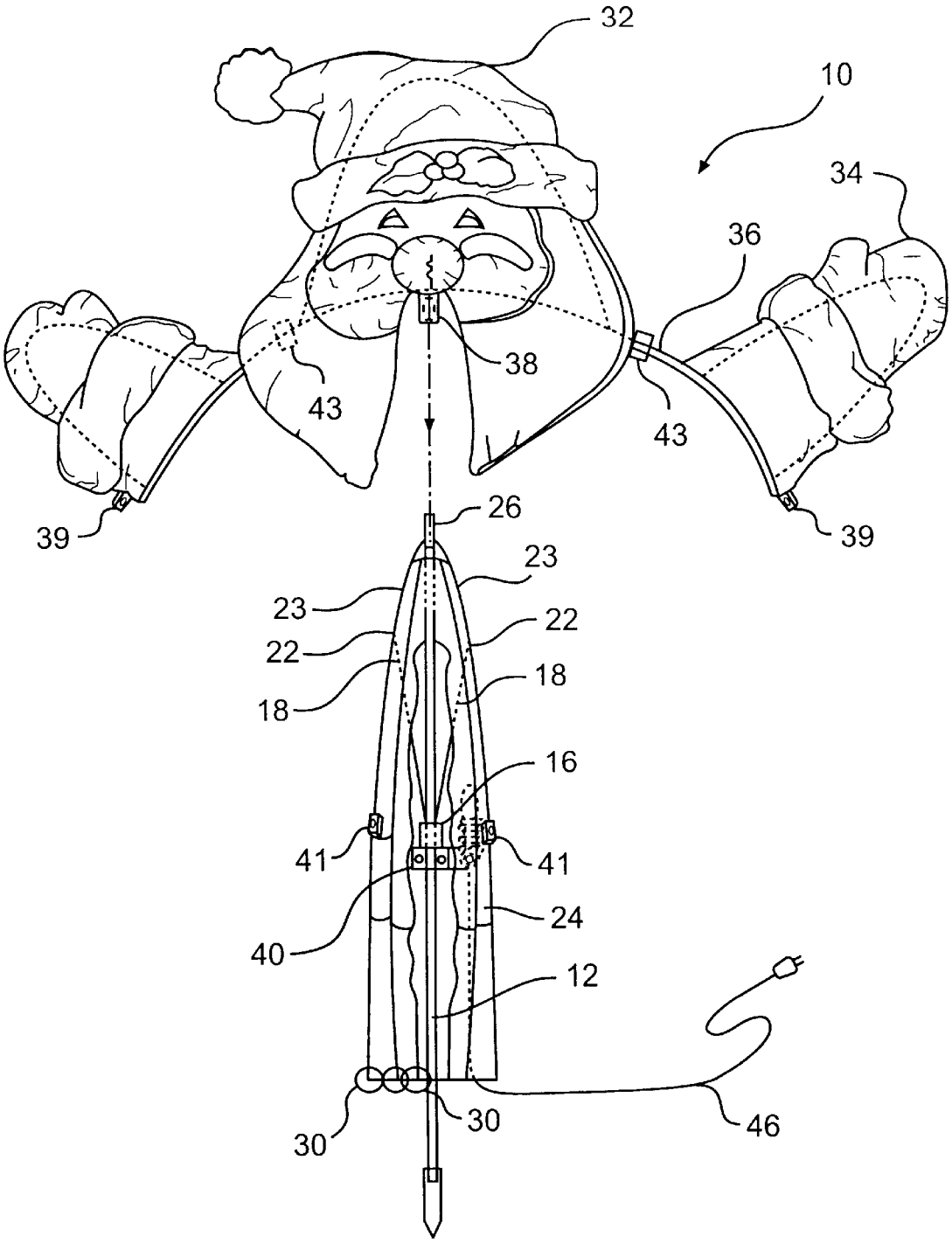
FIG. 2 is an elevational view of the preferred embodiment of the display device in a contracted or collapsed position in accordance with the present invention.

A preferred embodiment of the display device in accordance with the present invention is shown in FIGS. 1 and 2. As can be seen, the present invention includes features for easily expanding and collapsing a light-weight, lighted, three-dimensional display. The present invention is described below as applied to a three-dimensional Santa Claus figure by way of example.

Of course, the present invention may also be applied to any other figure such as the Easter Bunny or a snow man, or may have a holiday motif, or any other theme.

As shown in FIG. 1, the three-dimensional holiday display device 10 is primarily supported by a vertically oriented support post 12. The support post 12 may be constructed as a metal tube or of wood, fiberglass, plastic or any other suitably rigid and inexpensive material. A movable extension mechanism 14 is slidably mounted to the support post 12 such that the extension mechanism 14 may slide longitudinally along the support post 12 between an extended position (FIG. 1) and a retracted position (FIG. 2). The movable extension mechanism 14 includes a sliding member 16 disposed coaxially around the support post 12 loosely enough to allow such relative movement.

A plurality of extension members 18 are attached to the sliding member 16. Specifically, a rearward end 20 of each extension member 18 is pivotally attached to the sliding member 16 allowing the corresponding extension member 18 to pivot in a vertical plane with respect to the sliding member 16. The sliding member 16 and the extension members 18 may be constructed of metal, plastic or any other inexpensive and easily formed material.

A forward end 22 of each extension member 18 is also pivotably coupled to a flexible bow 23 which supports an inner surface of a fabric-like cover 24. More particularly, as shown in FIG. 1, each bow is pivotably coupled at a first end 25 to the support post 12 near its upper end, or mast 26. Each extension member 18 is similarly coupled pivotably to one bow 23 at a location between the first end and a lower free end of the bow 23. A relatively large number of bows 23, for example 10 to 20, may be provided in order to fully support and shape the cover 24 as shown in FIG. 1.

The support post, sliding member, extension member, and bows comprise a cover operating mechanism, the function of which is described in greater detail below.

As further shown in FIG. 1, the cover 24 partially surrounds and envelops the support post 12 when the display is in the assembled position. In addition, the upper end 26 of the support post 12 extends through, and is attached to, a reinforced portion 28 of the cover 24. The cover 24 may be formed from plastic, nylon or any other flexible, yet durable material and is preferably translucent so that it can be illuminated from within, as described in greater detail below. The cover may also carry a decorative design. For example, in the illustrated embodiment it can carry a design depicting Santa's belt, buttons on his coat and his boots.

It will be appreciated that the elements of the display mechanism thus far described are similar to a conventional umbrella. However, as shown in FIG. 1 the cover 24 is much more rounded and longer than a conventional umbrella.

The cover 24 is expanded by raising the sliding member 16 along the support post 12 toward the extended position. The upper portion of the cover 24 is securely held to the support post 12 by the reinforced portion 28 and is thereby prevented from moving along the support post 12. As the sliding member 16 moves along the post 12, each extension member 18 progressively pivots about its rearward end 20 attached to the sliding member 16. Consequently, the forward ends 22 of the extension members 18 become extended in a generally radial direction away from the sliding member 16 and thereby progressively expand the bows 23 and, in turn, expand the cover 24 supported on the bows 23. The cover 24 is fully expanded by the extension members 18 and bows 23 when the sliding member 16 reaches the extended position on the support post 12 (FIG. 1). The sliding member 16 can then releasably held at the extended position by a conventional locking or holding mechanism 25 such as a spring loaded lever or ball.

In the above-described configuration illustrated in FIG. 1, the cover 24 is fully expanded by the extension members 18 and is prevented from contracting by the locked sliding member 16. The resulting expanded three-dimensional cover 24 is sturdy and stable when the lower end of the support 12 is planted or otherwise secured to a base such as the ground, even if exposed to loads such as a moderate wind. In this respect, the support post 12 can be of such length that it projects below the lower margin of the cover 24 when expanded and the lower post end can be moderately pointed so that it can be forced into a base surface such as the ground as described. Alternatively, an independent hollow stake can be provided that is formed to mate with the lower end of the support post using, for example, a telescoping socket-like structure. The stake may then be driven into the ground and the lower post end mated with it in order to plant or secure the post.

To even further increase the sturdiness and stability of the expanded three-dimensional cover 24, a plurality of loops 30 are attached to the lower margin of the cover 24 at the lower or free end of each bow 23. The loops 30 may receive, for example, additional stakes (not shown) that are driven into or otherwise secured to the base to fix and securely anchor the cover 24. Any other suitable object, such as a relatively heavy weight, may cooperate with the loops 30 to anchor the lower periphery of the cover 24.

Figure 3:
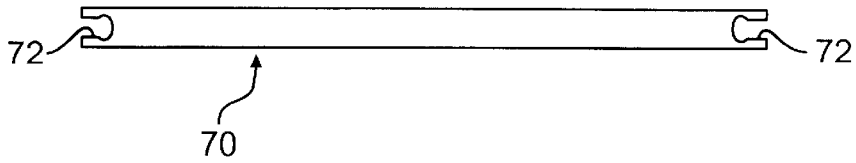
FIG. 3 is a plan view of a spacer used to provide stability to the lower margin of the cover when the display device is in the expanded position.
Figure 6:
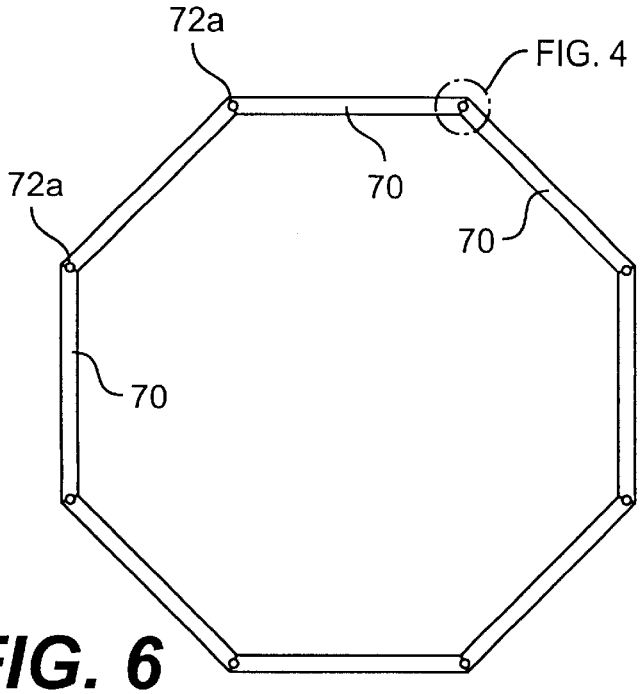
FIG. 6 is a bottom plan view of the display device assembled with spacers such as shown in FIGS. 3 to 5.

The display device may also include yet a further stabilizer configuration for equally spacing the lower ends of the bows 23 when the device is assembled. For example, as shown in FIG. 3, an elongated, flexible, yet resilient spacer 70 may be formed with notches 72 at each end. When the device is erected, a spacer 70 is mounted to span the distance between the lower or free ends of adjacent bows with one such lower end received in each notch 71. In this may the lower. margin of the cover may be shaped generally as a ring or circle, as shown in FIG. 6.

Figure 4:
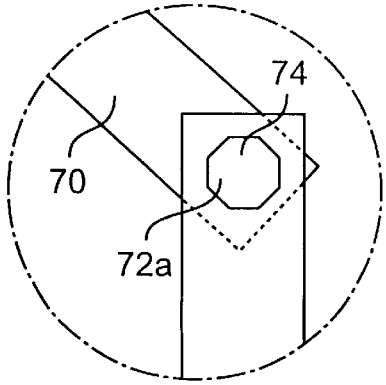
FIG. 4 is an enlarged plan view of the ends of the spacers assembled with the free end of one bow that supports the cover.
Figure 5:
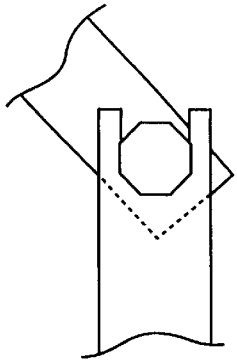
FIG. 5 is an enlarged plan view of an alternative configuration of two spacers and a free end of one bow.

As an enhancement, the lower or free end of each bow 23 may be formed with a polygonal cross-sectional shape 74, such as an octagon, and the notches may be formed as openings with a mating congruent shape 72*a*, as shown in FIG. 4, or 72*b*, as shown in FIG. 5. In this way, the angle between adjacent spacers 70 secured to the lower ends of the bows may be substantially maintained in the plane of the lower margin of the cover, as shown in FIG. 5.

Figure 7:
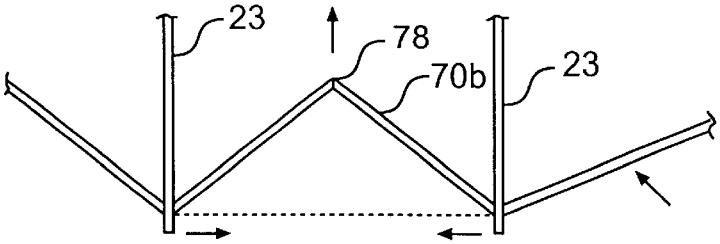
FIG. 7 is a perspective view of a portion of the bottom margin of the display device showing a further alternative spacer configuration.
Figure 8:
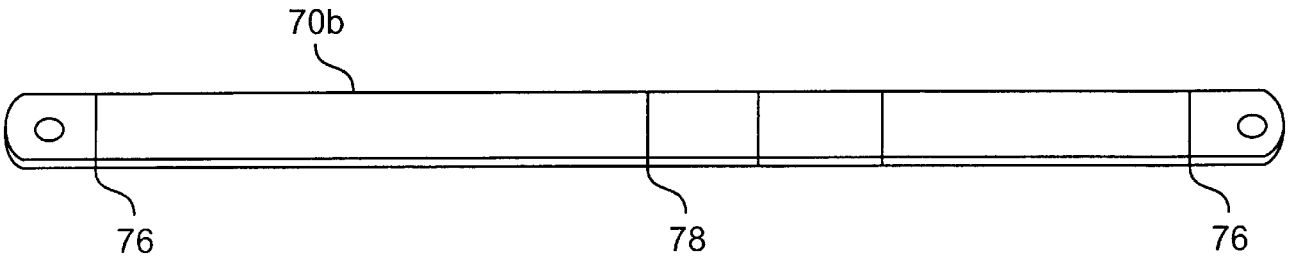
FIG. 8 is a detailed perspective view of the alternative spacer configuration shown in FIG. 7.
Figure 9:
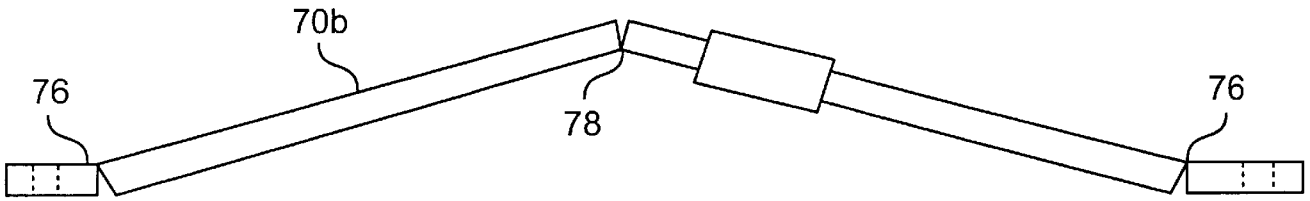
FIGS. 9 and 10 are side elevational views of the alternative spacer configuration shown respectively in a partially folded condition and an extended condition.
Figure 10:
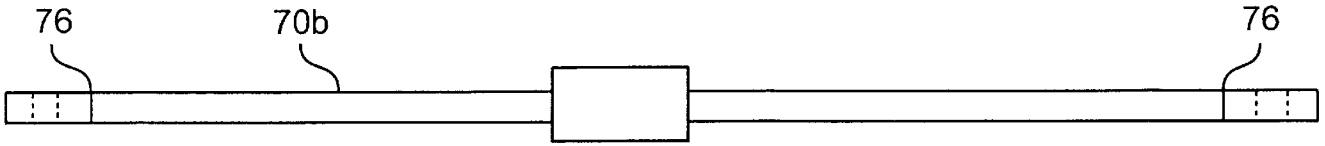

Yet another alternative to the stabilizer structure described above contemplates permanently securing spacers 70*b* to the lower margins of the bows 23 by flexible joints such as living hinges 76 as shown in FIG. 7. Each spacer 70*b* is also provided with a central flexible joint like a living hinge 78. A sliding collar 80 can be provided on the spacer 70*b* to embrace it about the living hinge 78 and thereby to hold it in its extended position as shown in FIG. 10. Accordingly, when the display device is assembled, the spacers 70*b* can be unfolded about each of their three hinge points and secured in place by the collar 80 thereby to provide stability to the structure. However, when disassembled the spacers 70*b* are permitted to refold with the bows and the remainder of the structure, for storage and shipment.

Figure 2A:
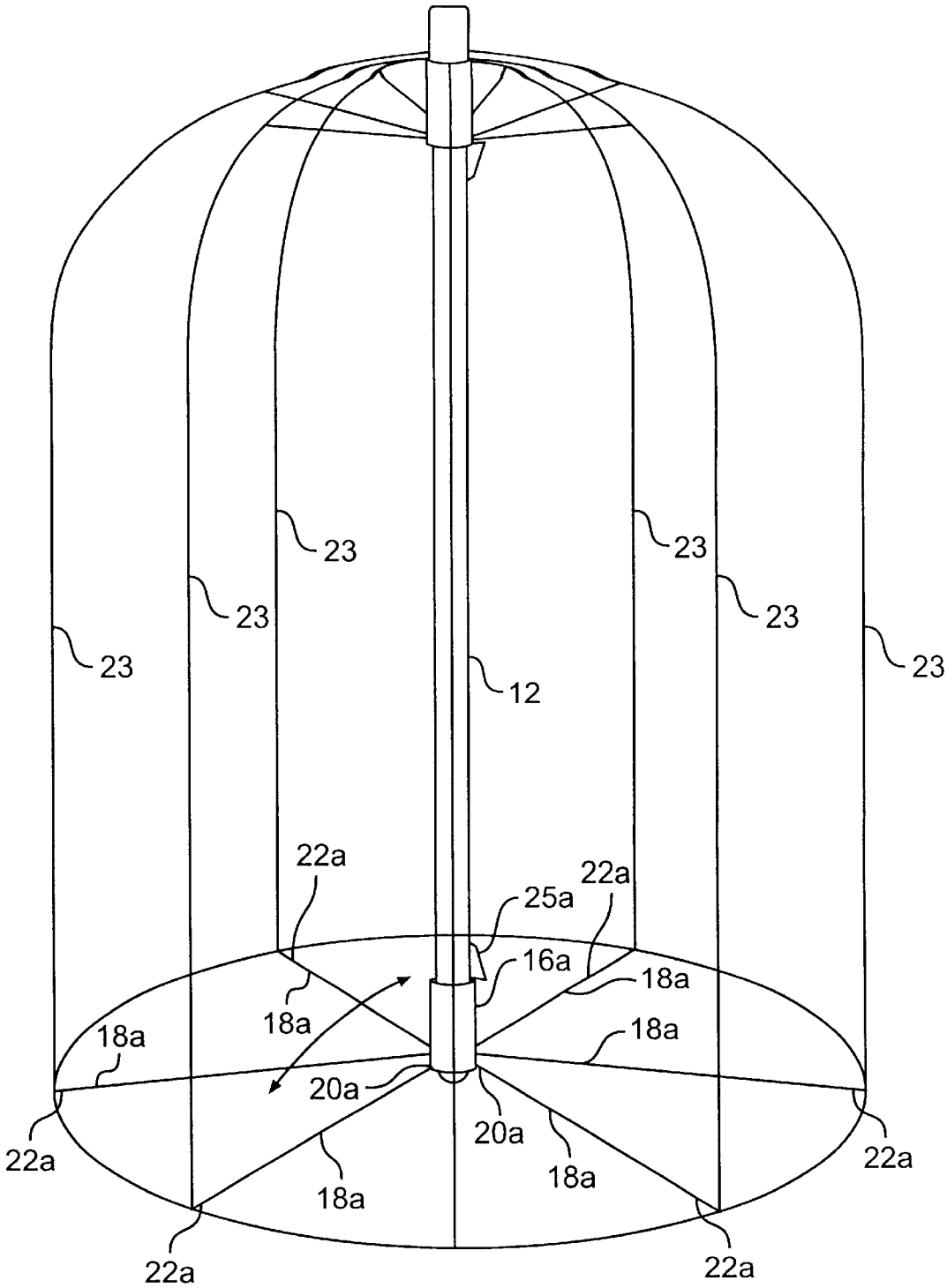
FIG. 2A is an elevational view of an additional embodiment, specifically of a cover operating mechanism which is an alternative to that shown in FIG. 1. This alternative mechanism is shown the expanded position.
Figure 2B:
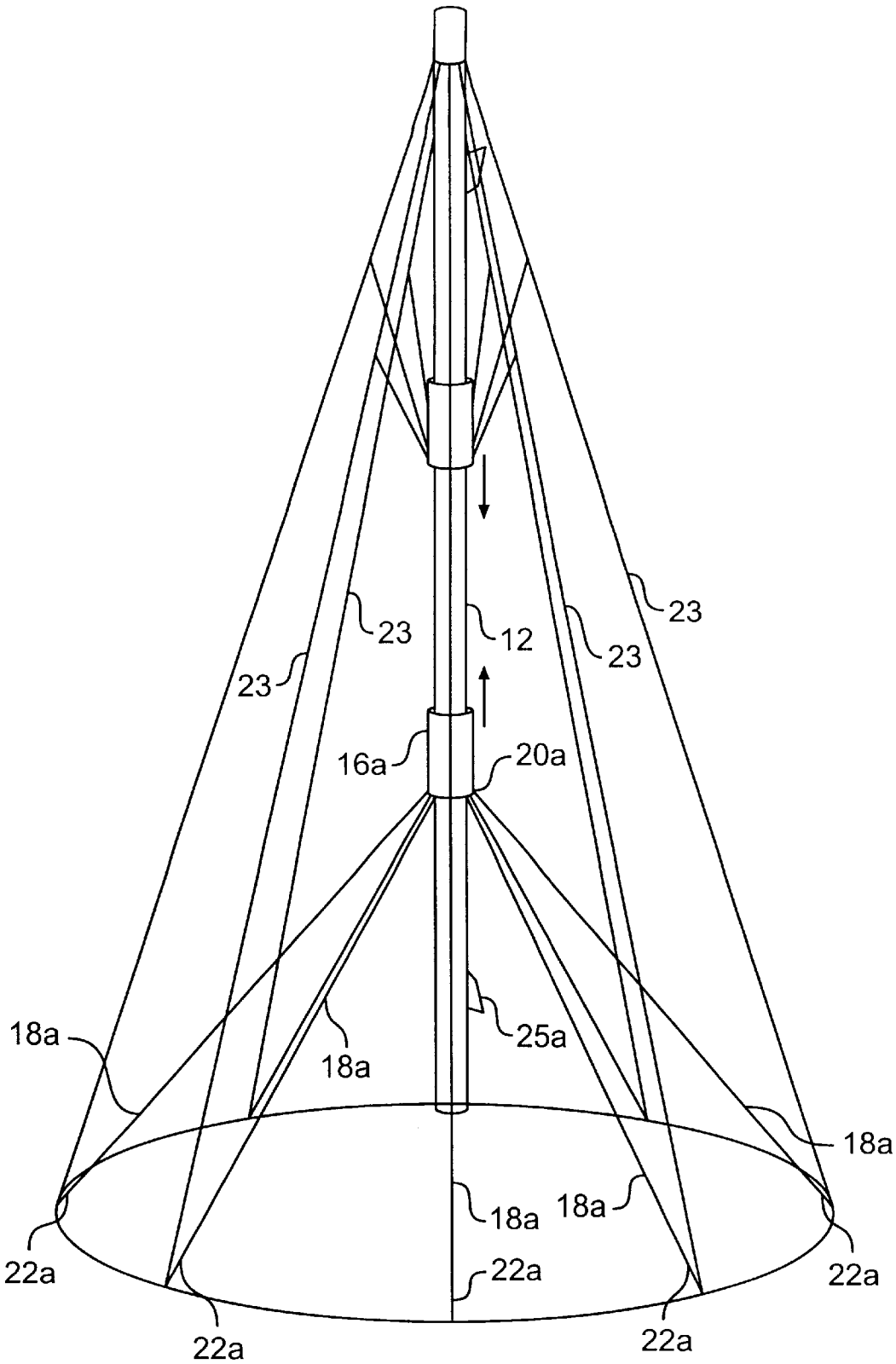
FIG. 2B is an elevation view of the alternative cover operating mechanism shown in the collapsed position.

FIGS. 2A and 2B also illustrate a second alternative embodiment of the cover operating mechanism that can be used independently or in cooperation with the stabilizer structures described above. In this configuration, a lower extension mechanism 14*a* cooperates with a lower portion of the support post 12. This mechanism includes a lower sliding member 16*a* to which each of a plurality of lower extension members 18*a* is pivotably secured at an inner or rearward end 20*a*. A forward end 22*a* of each lower extension member is pivotably coupled at or near the lower extreme of each bow 23. A lower locking mechanism 25*a* for the sliding member 16*a* is provided on the support post 12.

The sliding member 16*a* may be moved between an upper position on the support post 12, with the lower extension members 18*a* pulled (as seen in FIG. 2B), to an extreme lower position in which it is secured by the lower locking mechanism 25*a*. In the lower position the sliding member causes the lower extension members 18*a* to extend radially outwardly from the post 12, thereby to urge the lower extremes of the bows 23 outwardly, and cause the lower margin of the cover 25 to assume a generally circular configuration.

As will be understood, the second embodiment of the cover operating mechanism described above also enhances the stability of the assembled structure.

Of course, other stabilizer configurations can be envisioned by those skilled in the art.

As also shown in FIG. 1, to enhance the appearance of the display by adding interest and texture, an additional display piece 32 is mounted on the upper end or mast 26 of the support post 12, which extends through the cover 24, after the cover 24 has been expanded and anchored. The display piece 32 may include additional three-dimensional features 34, such as, for example, Santals face, scarf, hat and mittens. The display piece 32 is supported by a frame 36 constructed of metal, plastic or any other suitably rigid and durable material. The frame 36 includes a generally cylindrical socket 38 for receiving, and thereby being mounted to, the mast 26. When mounted on the mast 26, the display piece 32 may also be secured to the cover 24 by fasteners 39 such as snaps, clamps, hook and loop-type strips sold under the trademark VELCRO® strips or other known means at the extremes of the frame 36. The fasteners 39 will be designed to mate with and be secured to corresponding receptacles or mating hook and loop-type strips 41 mounted on the cover 24, each preferably located on and fixed to an underlying bow 23.

The frame 36 may also be provided with the hinges 43 so that it can be folded into a more compact configuration when the display device is disassembled for shipment or storage. That is, in the preferred embodiment shown in FIG. 1, Santa's hands can be folded inwardly over his face about the hinges 43.

A light fixture 40 for illuminating the assembled display 10 from within the translucent cover 24 is associated with the support post 12. The light fixture 40 includes a socket 42 mounted on the support post 12 and an electric light bulb 44 cooperating with the socket 42. Power may be supplied to the bulb 44 by a conventional power supply (not shown) using a conventional electrical cord 46. When power is supplied to the bulb 44, it attractively and safely illuminates the cover 24 from within. The bulb 44 may be turned on in a conventional fashion by, for example, operating a switch incorporated into the light fixture 40, or by merely connecting the electrical cord 46 to the power supply.

The light fixture 40 is accessible within the assembled display through a flap 48 located on a rearward portion of the cover 24. Thus, the light bulb 44 may be changed to a different color or intensity, or may be replaced if malfunctioning, by merely reaching through the flap 48. Such an arrangement allows the illumination provided by the bulb 44 to be adjusted without disassembling, moving, or otherwise disturbing the entire display device 10.

The display device 10 is assembled in the following manner. An operator holds the support post 12 and raises the sliding member 16 along the support post 12 in a direction toward the upper end 26 until the sliding member 16 reaches the extended position. The sliding member 16 is then held at the extended position by the locking mechanism 25. In this position the extension members 18 are extended generally radially away from the sliding member 16 and thereby position and support the bows 23 to, in turn, support the cover 24 in the fully expanded position. As shown in FIG. 1, the bows 23 may flex to an arcuate configuration under the constraint of the cover 24. The support post 12 and the expanded cover 24 may then be placed on and secured to the ground or any other suitable surface by planting the lower end of the post 12 in the surface. Stakes, or any other suitable means, can then be passed through the loops 30, if desired, to securely anchor the periphery of the cover 24 to the surface.

After the support post 12 and the three-dimensional cover 24 are secured to the surface, the additional display piece 32 is mounted to the mast 26 of the support post 12 by positioning the socket 38 of the frame 36 on the mast 26 of the support post 12. The extremities of the display piece 32 can then be secured to the cover 24 using the fasteners 39 and mating receptacles 41. An operator may then reach through flap 48 to manipulate the switch to turn on the light 40. Alternatively, the operator may connect the electrical cord 46 to the power supply. If the light bulb 44 malfunctions, or the operator wishes to change the color of illumination provided by the light bulb 44, he or she may reach through the flap 48 to replace the light bulb 44.

The holiday display device 10 of the invention is disassembled in the following fashion. First, the light 40 is turned off by reaching through the flap 48 and manipulating the switch, or by disconnecting the light 40 from the power supply. The display piece 32 is then disconnected and removed from the support post 12 and the stakes or other means are removed from the loops 30. To collapse the cover 24, the operator manipulates the locking mechanism 25 to release the sliding member 16 and moves the sliding member 16 along the support post 12 in a direction toward the retracted position. The extension members 18 can then rotate about their respective rearward ends 20 mounted to the sliding member 16 thereby retracting the forward ends 22 of the extension members 18 and permitting the bows 23 to collapse as the sliding member 16 approaches the retracted position. The retracting forward ends 22 thus collapse the cover 24, as shown in FIG. 2.

As also shown in FIG. 2, the cover 24 is relatively compact when collapsed. Thus, the device 10 can easily be carried and handled. Additionally, the cover 24, and the entire display device 10, may be easily and compactly stored when not in use.

For ease of explanation, the present invention has been described as having a single support post 12 and sliding member 16, with corresponding extension members 18 and bows 23. However, the present invention also encompasses an embodiment having a plurality of sliding members 16, with corresponding extension members 18, bows 23 and covers 24, moving along the support post 12. Plural sliding members 16, with corresponding extension members 18, bows 23 and covers 24, may expand multiple segments of a display such as, for example, multiple segments of a snow man.

While the present invention has been described with respect to what is at present considered to be the preferred embodiments, it is to be understood that the invention is not limited to these disclosed preferred embodiments. To the contrary, the invention is intended to cover various modifications and equivalent arrangements. The scope of the following claims is to be accorded the broadest interpretation so as to encompass all such modifications and equivalent structures and functions.

What is claimed is:

1. A display device, comprising:

a flexible cover;

a support post at least partially disposed within said cover;

cover-operating means associated with said cover and said support post operable alternately (a) to expand said cover to an enlarged configuration about said support post to provide a three dimensional display, and (b) to collapse said cover about said support post to a collapsed configuration; said cover being formed with an opening for providing access to the interior of said cover when in the enlarged configuration, and further comprising a movable flao covering said opening; and means for illuminating the interior of said cover.

2. A display device as recited in claim 1, wherein said cover-operating means comprises:

a sliding member; and a plurality of extension members, each mounted pivotably at one end on said sliding member and being operatively associated with said cover at a second end; said sliding member being mounted for reciprocal movement on said support post between an expanding position in which said extension members extend in a generally radial direction away from said support post thereby to urge said cover to said enlarged configuration, and a collapsing position in which said expanding members lie generally along said support post thereby to permit said cover to assume said collapsed configuration.

3. A display device as recited in claim 2, wherein said cover operating means further comprises:

a plurality of bows supporting the interior of said cover, each having a first end pivotably coupled to said support post and a free end, each said extension member being pivotably coupled to one said bow at a location between said first end and said free end.

4. A display device as recited in claim 2, further comprising a locking mechanism for releasably locking said sliding member in the expanding position.

5. A display device as recited in claim 2, wherein said cover operating means further comprises:

a second sliding member; and a second plurality of extension members, each mounted pivotably at one end on said second sliding member and being operatively associated with said cover at a second end; said second sliding member being mounted for reciprocal movement on said post between an expanding position in which said extension members extend in a generally radial direction away from said post thereby to urge said cover to said enlarged configuration, and a collapsing position in which said extension members lie generally along said support post thereby to permit said cover to assume said collapsed configuration.

6. A display device as recited in claim 5, wherein said cover operating means further comprises:

a plurality of bows supporting the interior of said cover, each having a first end pivotably coupled to said support post and a free end, each said second extension member being pivotably coupled to one said bow in the region of its free end.

7. A display device as recited in claim 5, further comprising a locking mechanism for releasably locking said second sliding member in the expanding position.

8. A display device as recited in claim 1, said illuminating means comprising a light fixture enclosed by said cover and mounted on said support post.

9. A display device as recited in claim 1, further comprising fastening means by which a lower margin of said cover can be secured to a base surface.

10. A display device as recited in claim 9, wherein said fastening means includes at least one loop mounted at the lower margin of said cover.

11. A display device as recited in claim 1, further comprising an additional display means mounted on said support post adjacent said cover.

12. A display device as recited in claim 11, wherein an end of said support post comprises a mast extending through said cover and said additional display means is mounted on said mast.

13. A display device as recited in claim 12, wherein said additional display means includes a frame having socket means for receiving said mast.

14. A display device as recited in claim 11, wherein said additional display means comprises a frame and fastening means for securing said frame with said cover.

15. A display device as recited in claim 14, wherein said fastening means comprises a fastener associated with one of said frame and said cover, and a receptacle for cooperating with said fastener and associated with the other of said frame and said cover.

16. A display device as recited in claim 15, wherein said fastener and said receptacle comprise mating hook and loop strips.

17. A display device as recited in claim 11, further comprising means permitting said additional display means to fold to a compact configuration.

18. A display device as recited in claim 1, further comprising means for securing said support post to a base surface.

19. A display device as recited in claim 18, wherein said securing means comprises a stake mountable on said base surface, said stake and said support post having means for joining the two together.

20. A display device as recited in claim 3, further comprising spacer means for separating the free ends of adjacent ones of said bows when said device is in said enlarged configuration.

21. A display device as recited in claim 20, wherein said spacer means comprises a spacer formed with a polygonal notch at each of two opposing ends and wherein the free end of each said bow is formed with a polygonal cross-section congruent to the polygonal notch in one end of said spacer, thereby to receive the polygonal notch and define an angle between said spacer and said bow.

22. A display device as recited in claim 20, wherein each said spacer means is mounted between free ends of adjacent ones of said bows and includes means permitting said spacer to fold when said device is placed in the collapsed configuration.

23. A display device, comprising:

a flexible cover;

a support post at least partially disposed within said cover;

cover-operating means associated with said cover and said support post operable alternately (a) to expand said cover to an enlarged configuration about said support post to provide a three-dimensional display, and (b) to collapse said cover about said support post to a collapsed configuration; and additional display means mounted on said support post adjacent said cover; said additional display means comprising a frame and fastening means for securing said frame with said cover; said fastening means comprising a fastener associated with one of said frame and said cover and a receptacle for cooperating with said fastener and associated with the other of said frame and said cover.

24. A display device as recited in claim 23, wherein an end of said support post comprises a mast extending through said cover and said additional display means is mounted on said mast.

25. A display device recited in claim 24, wherein said additional display means includes a frame having socket means for receiving said mast.

26. A display device as recited in claim 23, wherein said fastener and said receptacle comprise mating hook and loop strips.

27. A display device as recited in claim 23, wherein said cover-operating means comprises:

a sliding member; and a plurality of extension members, each mounted pivotably at one end on said sliding member and being operatively associated with said cover at a second end; said sliding member being mounted for reciprocal movement on said post between an expanding position in which said extension members extend in a generally radial direction away from said support post thereby to urge said cover to said enlarged configuration, and a collapsing position in which said expanding members lie generally along said support post thereby to permit said cover to assume said collapsed configuration.

28. A display device as recited in claim 27, wherein said cover operating means further comprises:

a plurality of bows supporting the interior of said cover, each having a first end pivotably coupled to said support post and a free end, each said extension member being pivotably coupled to one said bow at a location between said first end and said free end.

29. A display device as recited in claim 27, further comprising a locking mechanism for releasably locking said sliding member in the expanding position.

30. A display device as recited in claim 27, wherein said cover is formed with an opening for providing access to the interior of said cover when in the enlarged configuration, and further comprising a movable flap covering said opening.

31. A display device as recited in claim 27, wherein said cover operating means further comprises:

a second sliding member; and a second plurality of extension members, each mounted pivotably at one end on said second sliding member and being operatively associated with said cover at a second end; said second sliding member being mounted for reciprocal movement on said post between an expanding position in which said extension members extend in a generally radial direction away from said post thereby to urge said cover to said enlarged configuration, and a collapsing position in which said extension members lie generally along said support post thereby to permit said cover to assume said collapsed configuration.

32. A display device as recited in claim 31, wherein said cover operating means further comprises:

a plurality of bows supporting the interior of said cover, each having a first end pivotably coupled to said support post and a free end, each said second extension member being pivotably coupled to one said bow in the region of its free end.

33. A display device as recited in claim 31, further comprising a locking mechanism for releasably locking said second sliding member in the expanding position.

34. A display device as recited in claim 23, wherein said cover is formed with an opening for providing access to the interior of said cover when in the enlarged configuration, and further comprising a movable flap covering said opening.

35. A display device as recited in claim 23, further comprising illuminating means for illuminating the interior of said cover.

36. A display device as recited in claim 35, said illuminating means comprising a light fixture enclosed by said cover and mounted on said support post.

37. A display device as recited in claim 23, further comprising fastening means by which a lower margin of said cover can be secured to a base surface.

38. A display device as recited in claim 37, wherein said fastening means includes at least one loop mounted at the lower margin of said cover.

39. A display device as recited in claim 23, further comprising means permitting said additional display means to fold to a compact configuration.

40. A display device as recited in claim 23, further comprising means for securing said support post to a base surface.

41. A display device as recited in claim 40, wherein said securing means comprises a stake mountable on said base surface, said stake and said support post having means for joining the two together.

42. A display device as recited in claim 23, further comprising spacer means for separating the free ends adjacent ones of said bows when said device is in said enlarged configuration.

43. A display device as recited in claim 42, wherein said spacer means comprises a spacer formed with a polygonal notch at each of two opposing ends and wherein the free end of each said bow is formed with a polygonal cross-section congruent to the polygonal notch in one end of said spacer, thereby to receive the polygonal notch and define an angle between said spacer and said bow.

44. A display device as recited in claim 42, wherein each said spacer means is mounted between free ends of adjacent ones of said bows and includes means permitting said spacer to fold when said device is placed in the collapsed configuration.

45. A display device, comprising:

a flexible cover;

a support post at least partially disposed within said cover;

cover-operating means associated with said cover and said support post operable alternately (a) to expand said cover to an enlarged configuration about said support post to provide a three-dimensional display, and (b) to collapse said cover about said support post to a collapsed configuration; and means by which a lower margin of said cover can be secured to a base surface.

46. A display device as recited in claim 45, wherein said fastening means includes at least one loop mounted at the lower margin of said cover.

47. A display device as recited in claim 46, wherein said cover-operating means comprises:

a sliding member; and a plurality of extension members, each mounted pivotably at one end on said sliding member and being operatively associated with said cover at a second end; said sliding member being mounted for reciprocal movement on said post between an expanding position in which said extension members extend in a generally radial direction away from said support post thereby to urge said cover to said enlarged configuration, and a collapsing position in which said expanding members lie generally along said support post thereby to permit said cover to assume said collapsed configuration.

48. A display device as recited in claim 47, wherein said cover operating means further comprises:

a plurality of bows supporting the interior of said cover, each having a first end pivotably coupled to said support post and a free end, each said extension member being pivotably coupled to one said bow at a location between said first end and said free end.

49. A display device as recited in claim 47, further comprising a locking mechanism for releasably locking said sliding member in the expanding position.

50. A display device as recited in claim 48, wherein said cover operating means further comprises:

a second sliding member; and a second plurality of extension members, each mounted pivotably at one end on said second sliding member and being operatively associated with said cover at a second end; said second sliding member being mounted for reciprocal movement on said post between an expanding position in which said extension members extend in a generally radial direction away from said post thereby to urge said cover to said enlarged configuration, and a collapsing position in which said extension members lie generally along said support post thereby to permit said cover to assume said collapsed configuration.

51. A display device as recited in claim 50, wherein said cover operating means further comprises:

a plurality of bows supporting the interior of said cover, each having a first end pivotably coupled to said support post and a free end, each said second extension member being pivotably coupled to one said bow in the region of its free end.

52. A display device as recited in claim 50, further comprising a locking mechanism for releasably locking said second sliding member in the expanding position.

53. A display device as recited in claim 45, wherein said cover is formed with an opening for providing access to the interior of said cover when in the enlarged configuration, and further comprising a movable flap covering said opening.

54. A display device as recited in claim 45, further comprising illuminating means for illuminating the interior of said cover.

55. A display device as recited in claim 54, said illuminating means comprising a light fixture enclosed by said cover and mounted on said support post.

56. A display device as recited in claim 45, further comprising fastening means by which a lower margin of said cover can be secured to a base surface.

57. A display device as recited in claim 56, wherein said fastening means includes at least one loop mounted at the lower margin of said cover.

58. A display device as recited in claim 45, further comprising an additional display means mounted on said support post adjacent said cover.

59. A display device as recited in claim 58, wherein an end of said support post comprises a mast extending through said cover and said additional display means is mounted on said mast.

60. A display device as recited in claim 59, wherein said additional display means comprises a frame and fastening means for securing said frame with said cover.

61. A display device as recited in claim 60, wherein said fastening means comprises a fastener associated with one of said frame and said cover, and a receptacle for cooperating with said fastener and associated with the other of said frame and said cover.

62. A display device as recited in claim 61, wherein said fastener and said receptacle comprise mating hook and loop strips.

63. A display device as recited in claim 58, further comprising means permitting said additional display means to fold to a compact configuration.

64. A display device as recited in claim 45, further comprising means for securing said support post to a base surface.

65. A display device as recited in claim 64, wherein said securing means comprises a stake mountable on said base surface, said stake and said support post having means for joining the two together.

66. A display device as recited in claim 48, further comprising spacer means for separating the free ends adjacent ones of said bows when said device is in said enlarged configuration.

67. A display device as recited in claim 66, wherein said spacer means comprises a spacer formed with a polygonal notch at each of two opposing ends and wherein the free end of each said bow is formed with a polygonal cross-section congruent to the polygonal notch in one end of said spacer, thereby to received the polygonal notch and define an angle between said spacer and said bow.

68. A display device as recited in claim 66, wherein each said spacer means is mounted between free ends of adjacent ones of said bows and includes means permitting said spacer to fold when said device is placed in a collapsed configuration.

* * * * *

UNITED STATES PATENT AND TRADEMARK OFFICE

CERTIFICATE OF CORRECTION

PATENT NO. : 6,284,330 B1
DATED : September 4, 2001
INVENTOR(S) : Terry Hermanson It is certified that error appears in the above-identified patent and that said Letters Patent is hereby corrected as shown below:

Column 5,
Line 42, "Santals" should read -- Santa's --;
Line 50, "strips" should be deleted..

Column 7,
Line 35, "flao" should read -- flap --.

Column 10,
Line 52, "23" should read -- 27 --;
Line 53, "ends" should read -- ends of --.

Column 12,
Line 49, "ends" should read -- ends of --.

Signed and Sealed this

Twenty-eighth Day of May, 2002

*Attest:*

*Attesting Officer*

JAMES E. ROGAN
*Director of the United States Patent and Trademark Office*